US007703729B1

(12) United States Patent
Nourollahi

(10) Patent No.: US 7,703,729 B1
(45) Date of Patent: Apr. 27, 2010

(54) UNIVERSAL VIBRATION CONTROL STAND FOR HIGH QUALITY AUDIO EQUIPMENT

(76) Inventor: Abbas Nourollahi, P.O. Box 270004, San Diego, CA (US) 92198

( * ) Notice: Subject to any disclaimer, the term of this patent is extended or adjusted under 35 U.S.C. 154(b) by 0 days.

(21) Appl. No.: 12/171,288

(22) Filed: Jul. 10, 2008

(51) Int. Cl.
*A47B 91/00* (2006.01)

(52) U.S. Cl. ..... 248/188.9; 248/346.01; 248/562

(58) Field of Classification Search ..... 248/562, 248/566, 599, 615, 633, 634, 677, 188.7, 248/188.8, 188.9, 346.05, 346.01; 181/199, 181/207, 209
See application file for complete search history.

(56) References Cited

U.S. PATENT DOCUMENTS 3,952,983 A * 4/1976 Crochet ..... 248/173
5,333,825 A * 8/1994 Christensen ..... 248/188.2
5,681,023 A 10/1997 Sheydayi
5,872,340 A 2/1999 Anagnos et al.
6,155,530 A 12/2000 Borgen
7,267,318 B2 9/2007 Kennard, IV
D564,867 S * 3/2008 Levin ..... D8/374

* cited by examiner

*Primary Examiner*—A. Joseph Wujciak, III

(57) ABSTRACT

A universal height adjustable device for controlling the effects of vibrations on vibration sensitive audio equipment, particularly loudspeakers, by dampening the vibration and eliminating or minimizing the acoustic feedback, producing quality sound without distortion. This device is a collection of embodiments comprising of a centerpiece to hold the arms, feet to support the entire system, and swivel seats assembly with a right angle cut to allow the audio equipment to rest on. This device aims to preserve the acoustic advantages of spikes in a novel manner, without damaging the floor or modifying the loudspeaker enclosure which causes damage.

6 Claims, 5 Drawing Sheets

Centerpiece subassembly 60

Foot subassembly 80

Swivel seat subassembly 90

UNIVERSAL VIBRATION CONTROL STAND FOR HIGH QUALITY AUDIO EQUIPMENT

BACKGROUND

1. Field of Invention

This invention relates to the art of high quality audio equipment and, more particularly, audio loudspeaker systems, to dampen the vibration and eliminate or minimize the acoustic feedback, producing quality sound without distortion.

By term "speaker" as used herein, it will be understood that a speaker system is actually contemplated; i.e., one or more true speaker components housed in a specially designed enclosure.

Quality of sound corning from an audio loudspeaker would depend on what type of flooring the speaker is placed on. When a speaker is sitting on a tile, wooden, carpet, or concrete flooring, different acoustic feedback is resonating through the speaker enclosure which adversely affects the quality of the sound.

The intention of this invention is to eliminate the variable factor of flooring by minimizing the contact point between the speaker enclosure and the floor. This is achieved by placing the loudspeaker on a special designed stand. Even though this would eliminate the vibration to a great extent, additionally, another intention is to dampen the vibration and eliminate or further minimize the acoustic feedback by using damping material.

2. Prior Art

Description of the Prior Art

Even though previous attempts to address the stated problem have been successful to dampen the vibration and reduce the acoustic feedback, they all have their own profound disadvantages and limitations, such as some require major modification to the speaker's enclosure for installation. U.S. Pat. No. 6,155,530 issued to Borgen on Dec. 5, 2000 requires drilling holes into the enclosure for installation of mounting foot device which would cause damage to the expensive enclosure. Another similar device, U.S. Pat. No. 5,872,340, issued to Anagnos et al. suggests mounting feet that need to be drilled into the enclosures, again causing damage to the enclosure.

Other suggestions are mounting devices with sharp spikes to be attached to the bottom of the enclosures and placed on the flooring. This kind of mounting device causes severe damage to the flooring, such as carpet, wooden or any other flooring. U.S. Pat. No. 5,681,023 issued to Sheydayi on Oct. 28, 1997 is a good example of that which the sharp spike needs to penetrate through the carpet, and any padding to an underlying rigid floor which is damaging to the flooring, it is costly and therefore is unacceptable.

Another suggestion for a mounting device is U.S. Pat. No. 7,267,318 issued to Kennard on Sep. 11, 2007 which simply places a damping device under the audio loudspeaker. The problem with this suggestion is the device is not height adjustable which is essential for those who are keen to the art of music. Furthermore, constant pressure on the soft pliable material causes the material to lose its damping effect within a short period of time and the device would be ineffective.

Accordingly, the objectives of my invention are to provide a stand for audio equipment, particularly a loudspeaker which effectively isolates the speaker enclosure from direct contact with the flooring. This invention effectively dampens the resonant vibrations from the enclosure to provide a smoother bass response that substantially more nearly follows the frequency curve of an input signal.

Another objective of my invention is to provide such a device which eliminates any damage to the flooring.

This invention does not require any modifications to the speaker enclosure; therefore, there will not be any damage to the enclosure.

This invention conforms to any shape of a loudspeaker enclosure. Additionally, this invention can be adjusted to different sizes of speakers. A further objective of this invention is to provide a stand that is height adjustable to change the listening axis of the loud speaker to the listener's ear level for optimum sound quality.

SUMMARY OF THE INVENTION

Broadly the present invention provides to preserve the acoustic advantages of spikes in a novel manner, while simultaneously protecting the floor against the spike's damage. Other novel features of this invention are the device can fit any shape of the speaker or audio equipment and it is also height adjustable to the listener's ears. Furthermore there is no need for modifying the enclosure for installation of this device.

More details of the invention are disclosed in the attached patent claims.

BRIEF DESCRIPTIONS OF THE DRAWINGS

Description: The novel features believed characteristic of the invention are set forth in the claims. The invention itself will best be understood by reference to the following detailed description of illustrative embodiments when read in conjunction with the accompanying drawings, wherein:

DRAWING

Reference Numerals

Figure 1:
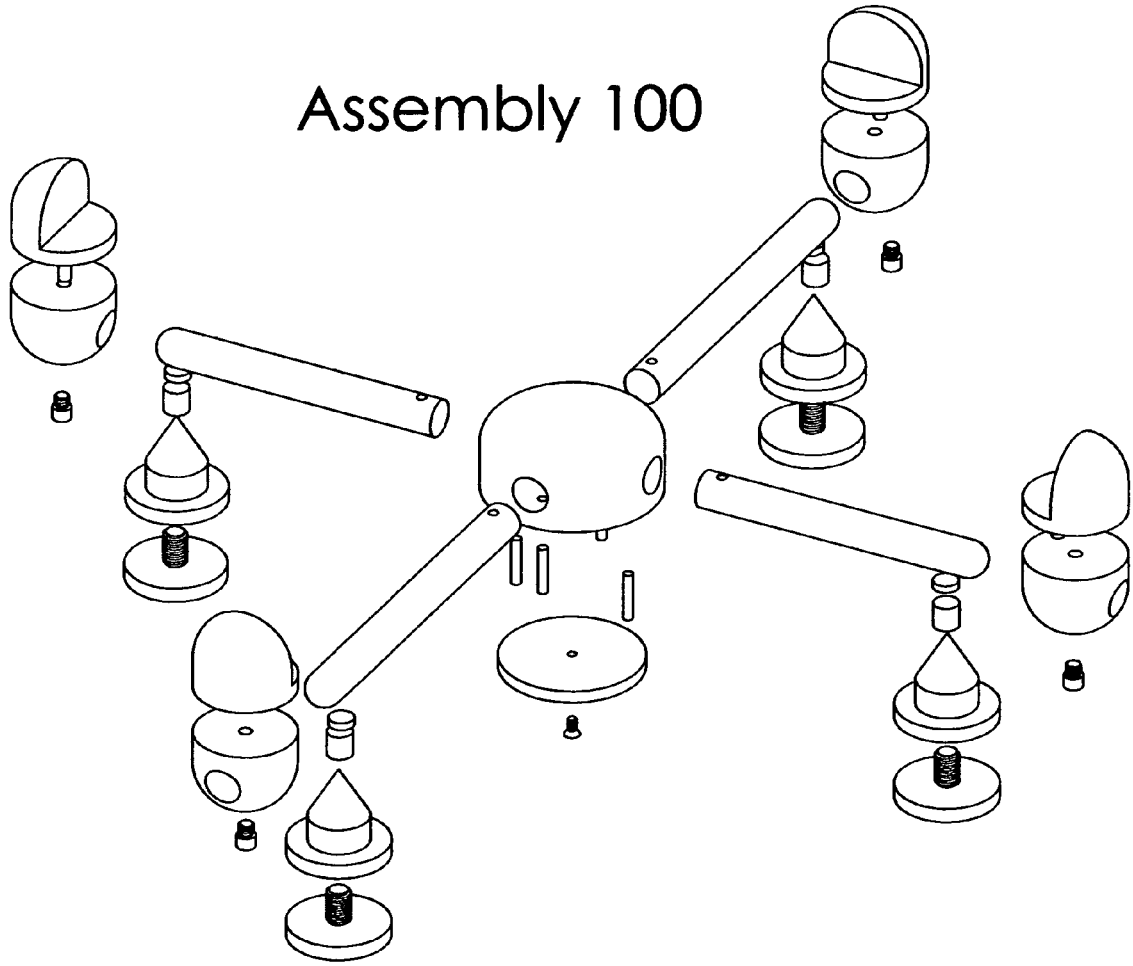
FIG. 1 is an exploded isometric view of the speaker stand in conformance with the present invention.

60 Centerpiece subassembly
61 Centerpiece
62 Centerpiece tapped hole
63 Centerpiece dowel pin holes
64 Centerpiece arm hole
65 Centerpiece cover
66 Centerpiece dowel pins
67 Centerpiece cover thru hole
68 Screw
69 Bolt
70 Arm subassembly
71 Arm
72 Piston cavity
73 Vibration damping material
74 Piston
75 Conical cavity

76 Arm dowel pin hole
80 Foot subassembly
81 Lower foot
82 Upper foot
83 Lower foot threaded stub
84 Upper foot tapped hole
85 Conical tip
90 Swivel seat subassembly
91 Swivel seat lower part
92 Swivel seat dowel pin
93 Swivel seat upper part
94 Swivel seat arm hole
95 Tapped hole
96 Bolt counterbore
97 Counterbore lower
98 Counterbore upper
99 Right angle seat
100 Speaker stand assembly

DETAILED DESCRIPTION OF THE INVENTION

Referring now to the figures and in particular to FIG. 1, preferred embodiments of the invention and its use will be described.

Figure 2:
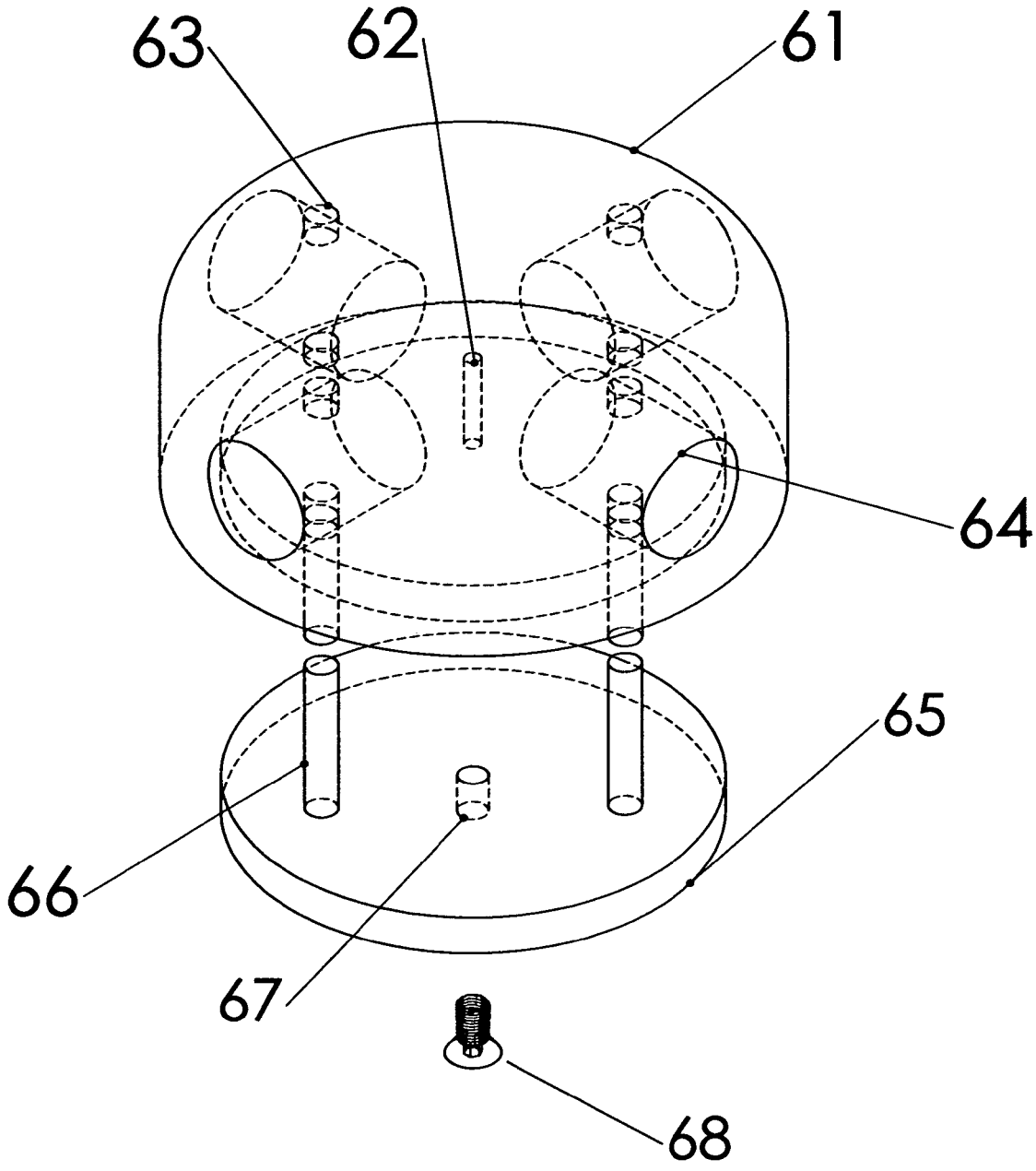
FIG. 2 is an isometric view of the centerpiece and centerpiece cover subassembly in conformance with the present invention.
Figure 3:
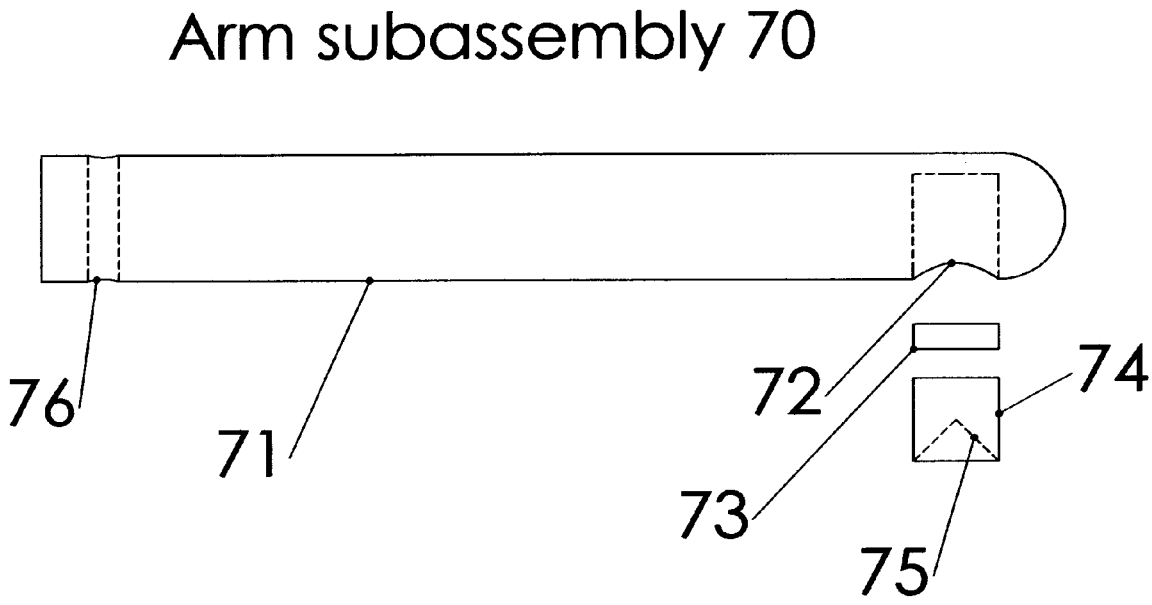
FIG. 3 is a side view of arm subassembly, damping material, and piston in conformance with the present invention.
Figure 4:
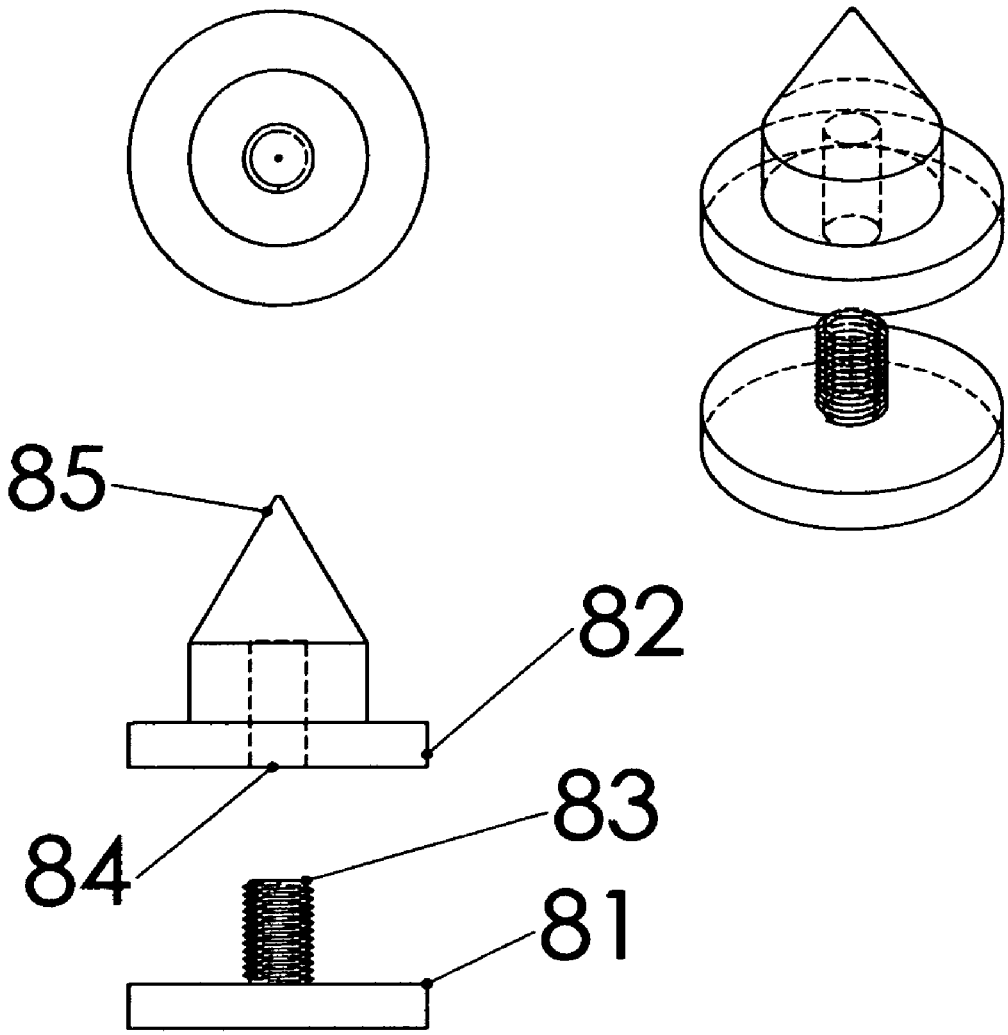
FIG. 4 is an isometric, top, and side view of the adjustable foot subassembly (top and bottom) in conformance with the present invention.
Figure 5:
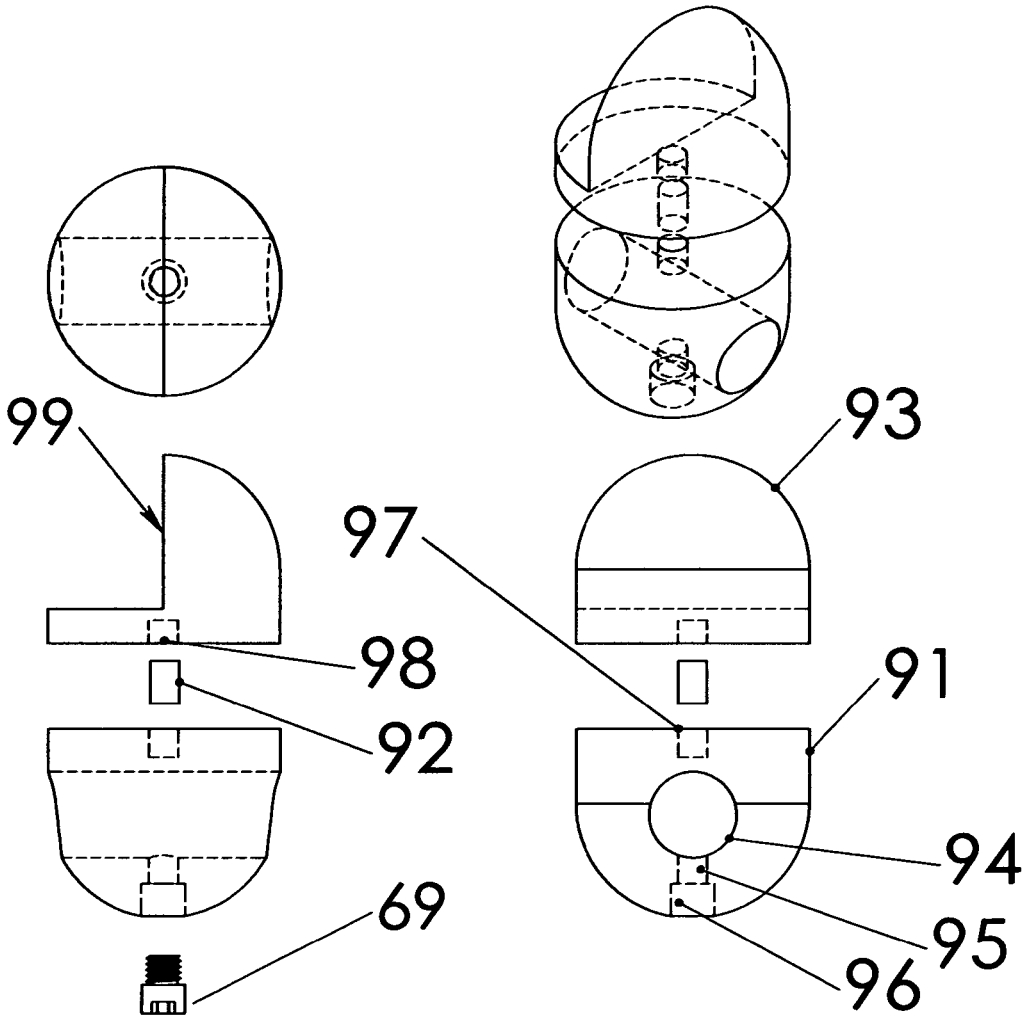
FIG. 5 is an isometric, top, and side view of the swivel seat subassembly (top and bottom) in conformance with the present invention.

FIG. 1 illustrates a preferred embodiment universal vibration control stand for high quality audio equipment, particularly high quality audio loudspeaker systems, assembly 100, which comprises four principle embodiments: centerpiece subassembly 60 FIG. 2, arm subassembly 70 FIG. 3, foot subassembly 80 FIG. 4, and swivel seat subassembly 90 FIG. 5, these subassemblies assemble to form the whole device of the invention. Descriptions of the subassemblies are as follows:

FIG. 2 illustrates a preferred embodiment centerpiece subassembly 60 which comprises centerpiece 61 consisting of four holes 64 to accept the four arms 71 at 90 degree angles by means of inserting the dowel pins 66 through the dowel pin holes 63. Centerpiece cover 65 attaches to centerpiece 61 by screw 68 through hole 67 and tapped hole 62.

FIG. 3 illustrates a preferred embodiment of the arm subassembly 70 which comprises of four arms 71 which extends from centerpiece 61 by means of dowel pins 66 through dowel pin hole 76. Quantity of this embodiment 71 could vary based on the size of the speaker system. For example, for a smaller speaker three arms could be sufficient and for a bigger speaker five arms or even more could be used. In these cases the arm holes 64 on the centerpiece 61 need to be modified accordingly to accommodate the number of arms 71. Piston cavity 72 as shown is a cylindrical shape which houses the damping material 73 and the piston 74. One face of the damping material 73 is attached to the closed end of the piston cavity 72 and the other face of the damping material 73 is attached to the flat face of the piston 74 by means of adhesive material. Piston 74 diameter is slightly smaller (0.003-0.005 in) than diameter of the piston cavity 72 allowing the piston 74 to move vertically. The other face of the Piston 74 has a conical cavity 75 with a bigger angle to accept the conical tip 85 with a smaller angle from FIG. 4. Piston 74 should be manufactured from a rigid material that can withstand the weight of the entire speaker system resting on the sharp conical tip 85 of the upper foot 82 without distorting the piston's 74 conical cavity 75.

FIG. 4 illustrates a preferred embodiment foot subassembly 80. Universal stand contains four foot subassembly 80 which comprises of lower foot 81 which supports the weight of the entire system by means of threaded stub 83. This embodiment lower foot 81 allows the height adjustment of the stand by means of threaded stub 83. Upper foot 82 shows the conical tip 85 which engages with conical cavity 75. Furthermore, upper foot 82 assembles to the lower foot 81 by means of screwing to the threaded stub 83 into the tapped hole 84. The suggested material for foot subassembly 80 is to be manufactured from stainless steel or similar material with the same hardness to withstand the weight of the speaker and the stand.

FIG. 5 illustrates a preferred embodiment swivel seat subassembly 90. Universal stand contains four swivel seat subassemblies 90 which comprises of a swivel seat upper part 93 and a swivel seat lower part 91. Swivel seat lower part 91 slides on the arm 71 through arm hole 94 to adjust to size of audio equipment, particularly a loudspeaker and locks into the desired positions by bolt 69 through counterbore 96 and tap hole 95. Swivel seat upper part 93 with right angle 99 is for seating the audio equipment, particularly a loudspeaker. Counterbore 98 and 97 is for the dowel pin 92 for the swivel seat upper part 93 to pivot about dowel pin 92 axis. This feature enables universal stand to embrace any shape of audio equipment and particularly loudspeakers.

While the above is a complete description of specific embodiments of the present invention, various modifications, variations, and alternatives may be employed. For example, in the preferred embodiment upper swivel seat 93, the wall of the right angle 99 could be modified in a curved shape to embrace circular shape audio equipment, in particular, loudspeakers. Additionally, the entire universal stand can be manufactured in different sizes, from different material, and finishes. The universal stand embodiments can be manufactured by different means such as casting, machining, or other means.

While the invention is shown in only one of its forms, it is not thus limited but is susceptible to various changes and modifications without departing from the spirit and scope of the invention.

What is claimed is:

1. A universal vibration control stand for high quality audio equipment to dampen the vibration and eliminate or minimize the acoustic feedback, producing quality sound without distortion, comprising:

(a) a centerpiece that supports and positions arms at outer end thereof;

(b) said four arms extending from said outer end of centerpieces and supported by conical tips at the opposite end of arms, wherein the opposite end of each arm having opening forming a piston cavity extending upwardly in the bottom end thereof;

(c) four pieces of resilient dampening material housed in each arm's piston cavity;

(d) four cylindrical piston with top flat face attached to each damping material and the bottom of piston having a conical cavity, wherein each pistons is housed in each piston cavity;

(e) four upper feet with conical tips adapted to support said arms and having a tapped hole for assembly with a plurality of lower feet;

(f) a plurality of lower feet comprises four lower feet with threaded stubs threadably engage with each upper feet having a flat base for sitting on a floor;

(g) four upper swivel seats with right angle cut for supporting bottom edge of audio equipment connect with a dowel pin mounted in each plurality of lower swivel seats; wherein each plurality of lower swivel seats having aperture on one side thereof and wherein plurality of lower swivel seats comprise four lower swivel seats and (h) the aperture of each four said lower swivel seats is slidable on said end of each arms adjacent to the piston cavity and support said upper swivel seats.

2. The stand as disclosed in claim 1, wherein the centerpiece comprises of four holes to position and secure the arms by centerpiece dowel pins and the centerpiece further comprises cover assembly for mounting on the bottom of the said centerpiece by a screw, wherein the screw secures dowel pins within the centerpiece.

3. The stand as disclosed in claim 1, wherein the arms comprises a through hole to accept a dowel pin to secure said arm to the centerpiece.

4. The stand as disclosed in claim 1, wherein resilient damping material housed in the arm's piston cavity is manufactured from a urethane-based polymer material.

5. The stand as disclosed in claim 1, wherein the lower swivel seat is lock by bolt on the arm after being slided thereon.

6. The stand as disclosed in claim 1, wherein the threaded stud on the lower feet provides elevation support for the upper swivel feet.

* * * * *